US007926920B2

(12) United States Patent
Katayama

(10) Patent No.: US 7,926,920 B2
(45) Date of Patent: Apr. 19, 2011

(54) LIQUID DISCHARGING HEAD AND METHOD FOR PRODUCING THE LIQUID DISCHARGING HEAD

(75) Inventor: Naoki Katayama, Kariya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 876 days.

(21) Appl. No.: 11/903,622

(22) Filed: Sep. 24, 2007

(65) Prior Publication Data

US 2008/0180469 A1 Jul. 31, 2008

(30) Foreign Application Priority Data

Sep. 25, 2006 (JP) ..... 2006-258302

(51) Int. Cl.
*B41J 2/045* (2006.01)

(52) U.S. Cl. ..... 347/71

(58) Field of Classification Search ..... 347/71
See application file for complete search history.

(56) References Cited

U.S. PATENT DOCUMENTS 6,789,319 B2 * 9/2004 Furuhata et al. ..... 29/890.1

FOREIGN PATENT DOCUMENTS

JP 11300951 11/1999

* cited by examiner

*Primary Examiner* — Jerry T Rahll
(74) *Attorney, Agent, or Firm* — Frommer Lawrence & Haug LLP

(57) ABSTRACT

A liquid discharging head includes a channel unit formed of a plurality of stacked plates having openings and a liquid channel formed of the openings of the stacked plates. A curing material is filled in a step formed due to shift of the openings provided in the adjacent plates respectively, and the curing material forms part of an inner surface of the liquid channel. Consequently, the channel inner surface becomes smooth, and a liquid discharging head with little residual bubbles and with excellent bubble discharging capability is provided. Further, the attenuation of a pressure wave due to the step can be prevented.

8 Claims, 9 Drawing Sheets

LIQUID DISCHARGING HEAD AND METHOD FOR PRODUCING THE LIQUID DISCHARGING HEAD

CROSS REFERENCE TO RELATED APPLICATION

The present application claims priority from Japanese Patent Application No. 2006-258302, filed on Sep. 25, 2006, the disclosure of which is incorporated herein by reference in its entirety.

BACKGROUND OF THE INVENTION

1. Field of the Invention

The present invention relates to a liquid discharging head and a method for producing the liquid discharging head.

2. Description of the Related Art

There has been known a liquid discharging head formed of a plurality of stacked plates, having liquid channels which are formed by making openings formed in the respective plates communicate with one another, and discharging, from nozzles, a liquid flowing through the liquid channels.

In recent years, as the specifications of a liquid discharging head have become diversified, its producing methods have also become diversified. For example, the use of metal diffusion bonding for bonding plates to form a channel unit has an advantage of realizing firm bonding strength and excellent durability. Further, the number of processes can be reduced since the plural plates can be bonded at a time. Moreover, production cost can be reduced since a plurality of (several thousand) channel units can be produced at a time by batch processing. Further, the plates bonded by metal diffusion bonding have an advantage that they do not easily peel off from one another even if the plates are exposed to high temperature.

However, in a case where metal diffusion bonding is used to form the channel unit, the plates cannot be torn off after bonded. Therefore, even if steps and gaps occur in liquid channels due to, for example, positional deviation or shift of openings formed in the plates, it is not possible to tear off the plates to correct the positional deviation or shift. In the steps and gaps occurring in the liquid channels, bubbles contained in the liquid easily stay, and these bubbles prevent the smooth flow of the liquid. Further, it is difficult to discharge these bubbles even by purging. Further, if steps and gaps occur in descenders each of which communicates a nozzle and a pressure chamber for applying jetting pressure to the liquid, a pressure wave attenuates, resulting in low driving efficiency of an actuator. Thus, the head formed by metal diffusion bonding has problems that bubbles easily stay in the steps and the gaps occurring in the liquid channels and the bubbles prevent stable discharge of the liquid. Another problem is that the pressure wave attenuates due to the steps and the gaps, resulting in low driving efficiency of the actuator.

Japanese Patent Application Laid-open No. H11-300951 discloses an ink-jet head producing method in which, before a top plate having grooves is bonded to a substrate having discharge energy generating elements disposed on part of nozzles, a mixture of resin and air is sprayed to a bonding surface side of the top plate, thereby making surfaces of the nozzles curved in a cross-sectional view.

However, since the ink-jet head producing method described in Japanese Patent Application Laid-open No. H11-300951 is to make the surfaces of the nozzles curved in the cross-sectional view before bonding the top plate and the substrate. Therefore, this method is not applicable to steps which occur after a plurality of plates are bonded by, for example, metal diffusion bonding or the like, as a result of shift or positional deviation of openings formed in the plates.

SUMMARY OF THE INVENTION

It is an object of the present invention to provide a liquid discharging head formed of a plurality of stacked plates having openings, in which steps formed in inner surfaces of liquid channels formed of the openings overlapping with one another are smoothed by a low-viscosity curing material in a liquid form or a mist form introduced into the liquid channels, and a method for producing the liquid discharging head.

According to a first aspect of the present invention, there is provided a liquid discharging head which discharges a liquid from a nozzle, the head including: a channel unit formed by stacking a plurality of plates each of which has openings; and a liquid channel formed by the openings of the stacked plates, wherein the openings of adjacent plates among the plurality of plates are shifted to form a step, and a curing material is filled in the step, and the curing material forms part of an inner surface of the liquid channel.

According to the liquid discharging head of the present invention, since, in the inner surface of the liquid channel, the curing material is filled in the step formed due to the shift of the openings of the adjacent plates among the plurality of plates, the curing material makes the channel inner surface smooth. Therefore, in the liquid channel, the attenuation of a pressure wave due to such a step occurs little and residual bubbles are reduced, resulting in excellent bubble discharging capability.

In the liquid discharging head of the present invention, the plurality of plates may be bonded by metal diffusion bonding. In this case, since the step in the inner surface of the liquid channel, that is, the step formed due to the shift of the openings of the adjacent plates bonded by the metal diffusion bonding is smoothed by the curing material, the attenuation of a pressure wave due to the step occurs little and residual bubbles are reduced, resulting in excellent bubble discharging capability.

In the liquid discharging head of the present invention, the liquid which is discharged from the nozzle may be an ink. In this case, the inner surface of the liquid channel (ink channel) in the liquid discharging head as an ink-jet head can be smoothed.

In the liquid discharging head of the present invention, the curing material may be a thermosetting adhesive, and a piezoelectric layer may be formed on a predetermined surface of the channel unit by an aerosol deposition method.

In the liquid discharging head of the present invention, the step may be formed by a sidewall of a communication hole formed in one plate of the adjacent plates and a surface, of the other plate, bonded to the one plate. Further, the step may be formed as a recess in the inner surface of the liquid channel.

According to a second aspect of the present invention, there is provided a method for producing a liquid discharging head which discharges a liquid from a nozzle of a channel unit formed by stacking a plurality of plates each of which has openings, the method including: a first step for bonding the plates by metal diffusion bonding and making the openings of the plates communicate with one another to form a liquid channel; a second step for introducing a curing material in a liquid form or a mist form throughout the liquid channel; and a third step for introducing a fluid to the liquid channel until the curing material is dried.

According to the method for producing the liquid discharging head of the present invention, when the plates are stacked by metal diffusion bonding to form the liquid channel, it is possible to smooth a step formed in a channel inner surface by the curing material. At this time, gaps, flaws, and recesses can also be smoothed by the curing material. Therefore, the attenuation of a pressure wave due to the step of the liquid channel occurs little, and residual bubbles are reduced, which makes it possible to produce the liquid discharging head excellent in bubble discharging capability.

In the method for producing the liquid discharging head, the openings may be formed by half etching.

In the method for producing the liquid discharging head of the present invention, the curing material may be a thermosetting adhesive, and the fluid may be a high-temperature air. Further, a temperature of the high-temperature air may be about 70° C. to about 150° C. This makes it possible to introduce the thermosetting adhesive throughout the liquid channel and thereafter dry the thermosetting adhesive by the high-temperature air. Therefore, the thermosetting adhesive can form part of the inner surface of the liquid channel, which makes it possible to easily smooth the inner surface of the liquid channel.

In the method for producing the liquid discharging head of the present invention, the plates may include a nozzle plate stacked on an outermost side of the channel unit; other plates among the plurality of plates which are different from the nozzle plate may be bonded to form a stack in the first step; and the method may further include, after the third step, a fourth step for bonding the nozzle plate to the stack. Further, the nozzle plate may be bonded to the stack in the fourth step by an adhesive. This makes it possible to easily smooth the inner surface of the liquid channel without adversely affecting a water repellent film even in a case where the water repellent film is formed on the nozzle plate. Further, the channel can be free of steps formed due to the shift of the openings of the adjacent plates and thus the liquid can smoothly flow in the channel.

In the method for producing the liquid discharging head of the present invention, the first step may include forming a piezoelectric layer by an aerosol deposition method after forming the liquid channel, and may further include forming a plurality of individual surface electrodes on the piezoelectric layer.

DETAILED DESCRIPTION OF THE PREFERRED EMBODIMENTS

Figure 1A:
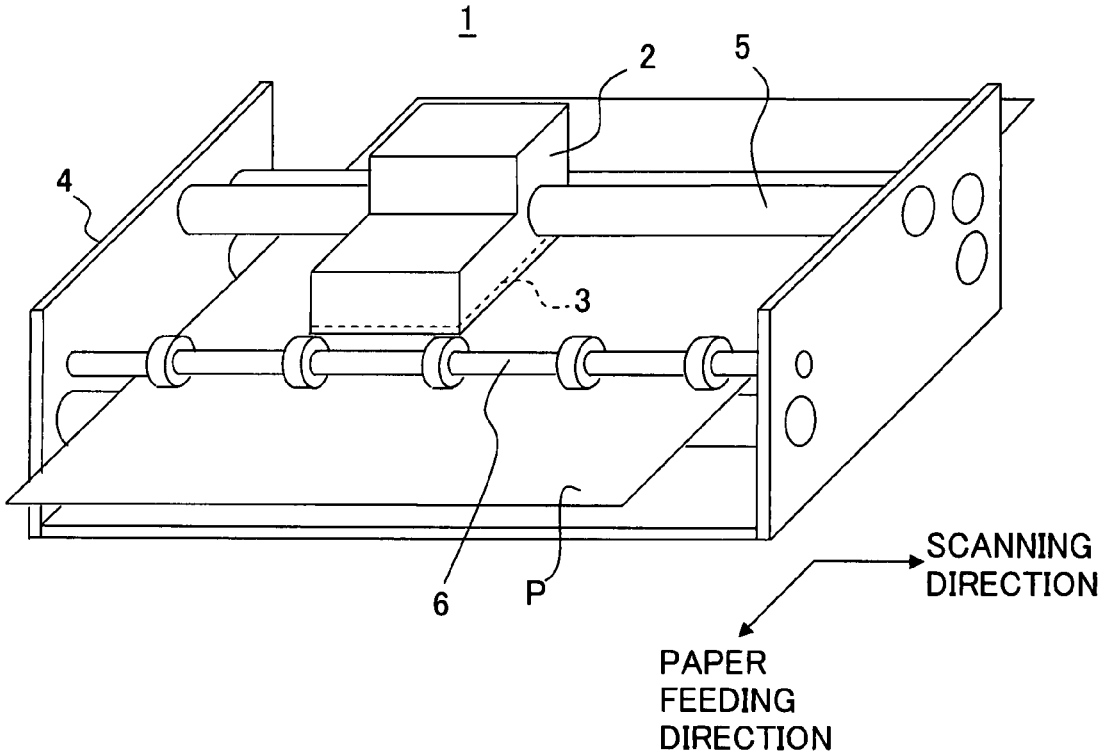
FIG. 1A shows a perspective view illustrating an ink-jet printer according to the present invention.

Hereinafter, an embodiment where the present invention is applied to an ink-jet printer head will be explained with reference to the drawings. FIG. 1A is shows a perspective view illustrating the structure of an ink-jet printer according to the present invention, and FIG. 1B is an explanatory view showing the arrangement relation of a channel unit, an actuator unit, and a flexible cable (COP) according to the present invention.

As shown in FIG. 1A, the ink-jet printer 1 according to the present invention includes a carriage 2 on which an ink cartridge (not shown) is mounted, and an ink-jet printer head 3 (hereinafter, simply referred to as a printer head) provided on a lower surface of the carriage 2 to perform recording to a recording paper P (recording medium). The carriage 2 is supported by a carriage shaft 5 and a guide plate (not shown) which are provided in a printer frame 4, and reciprocates in a scanning direction perpendicular to a paper feeding direction of the recording paper P.

The recording paper P is fed from a paper feed unit (not shown) in the paper feeding direction. Specifically, the recording paper P is guided into a position between a platen roller (not shown) and the printer head 3, predetermined recording is performed on the recording paper P by an ink jetted toward the recording paper P from the printer head 3, and thereafter the recording paper P is discharged by a discharge roller 6.

Figure 1B:
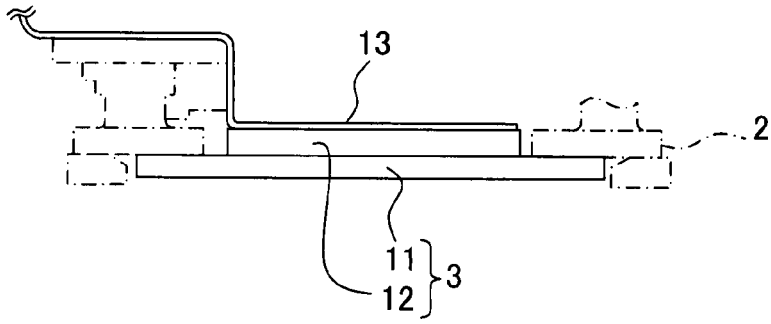
FIG. 1B is an explanatory view showing the arrangement relation of a channel unit, an actuator unit, and a flexible cable (COP) according to the present invention.
Figure 2A:
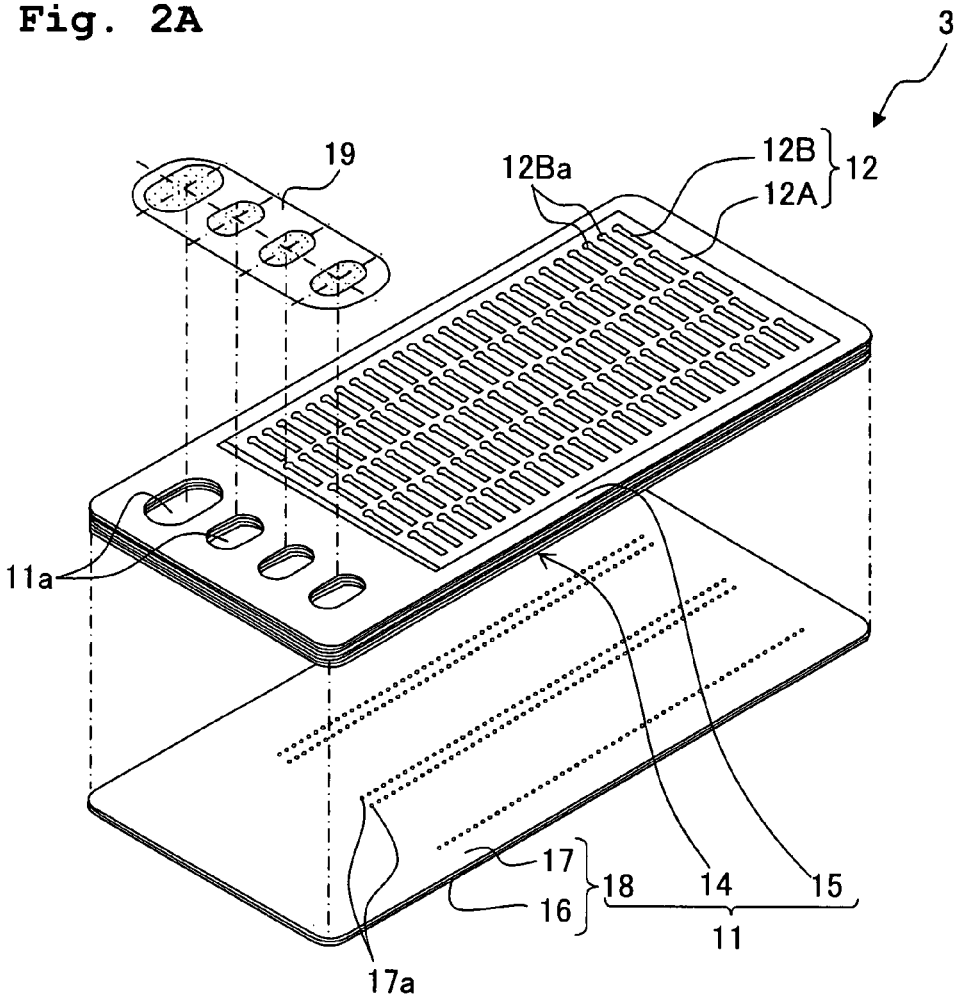
FIG. 2A is a perspective view showing a state where the actuator unit is pasted on an upper side of the channel unit.

As shown in FIG. 1B and FIG. 2A, the printer head 3 includes a channel unit 11 and an actuator unit 12, and a flexible cable 13 (signal line) supplying a driving signal is provided on a surface, of the actuator unit 12, not facing the channel unit 11. In the description below, a direction in which the channel unit 11 and the actuator 12 are stacked will be defined as an up and down direction.

Figure 2B:
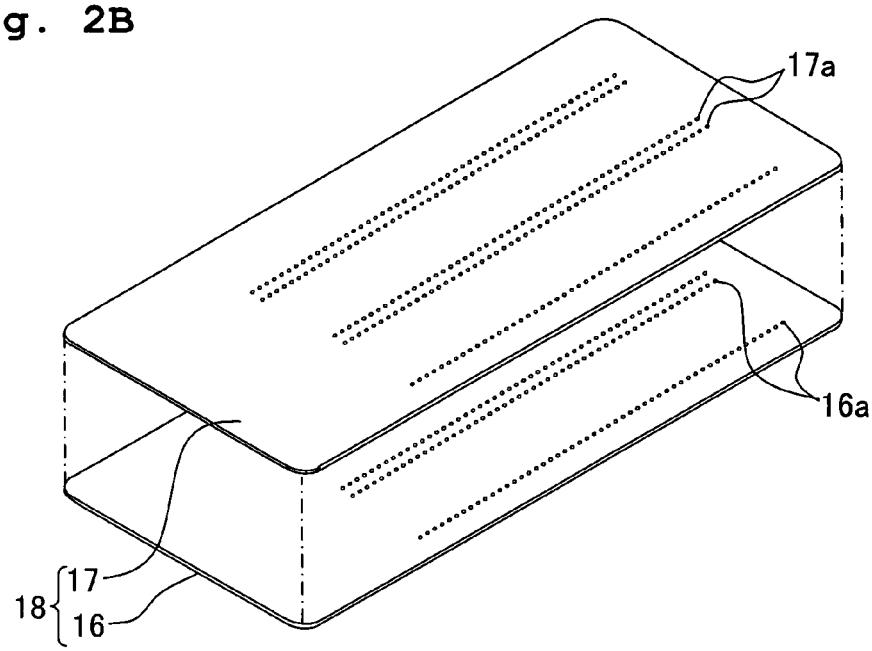
FIG. 2B is an exploded perspective view of a plate assembly composed of a nozzle plate and a spacer plate.
Figure 3A:
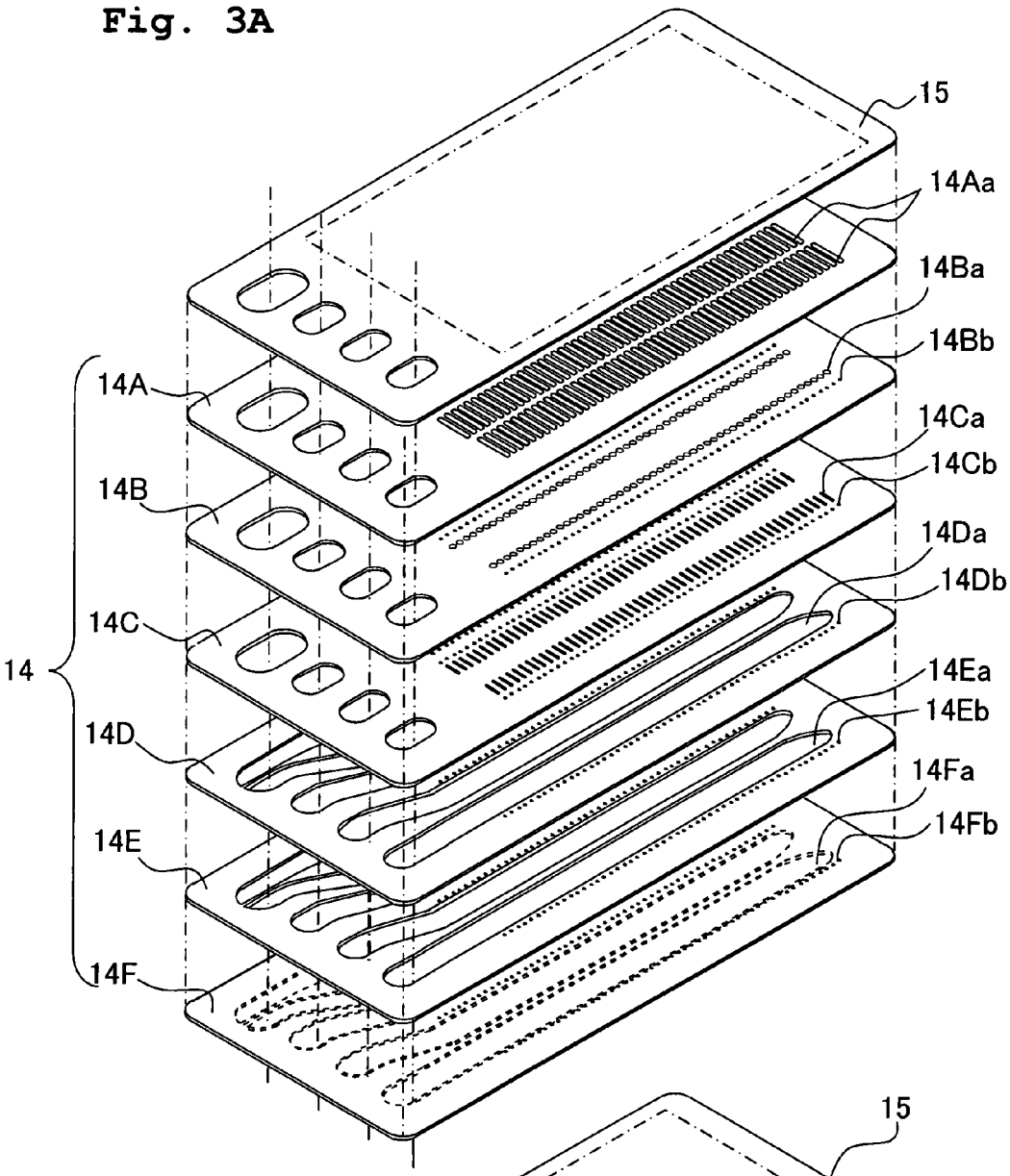
FIG. 3A is an exploded perspective view of a stack and a vibration plate.

As shown in FIG. 2A and FIG. 3A, the channel unit 11 includes a stack 14 formed of a plurality of stacked plates having openings. On an upper surface of the stack 14, a vibration plate 15 (to be described later) is provided. On a lower surface of the stack 14, a plate assembly 18 is bonded. As shown in FIG. 2B, the plate assembly 18 is composed of a nozzle plate 16 having nozzles 16*a* and a spacer plate 17 having through holes 17*a* corresponding to the nozzles 16*a* respectively. As shown in FIG. 2A, on an upper surface of the vibration plate 15, the actuator unit 12 is provided. Further, filters 19 to capture dust and the like contained in the ink are provided in openings 11*a* of the channel unit 11. The nozzle plate 16 is a synthetic polymeric resin plate (for example, polyimide) in which the nozzles 16*a* are formed. The nozzles 16*a* are formed by excimer laser processing applied to the synthetic polymeric resin plate, each corresponding to each of a plurality of pressure chambers 14Aa formed in a cavity plate 14A (to be described later).

Figure 3B:
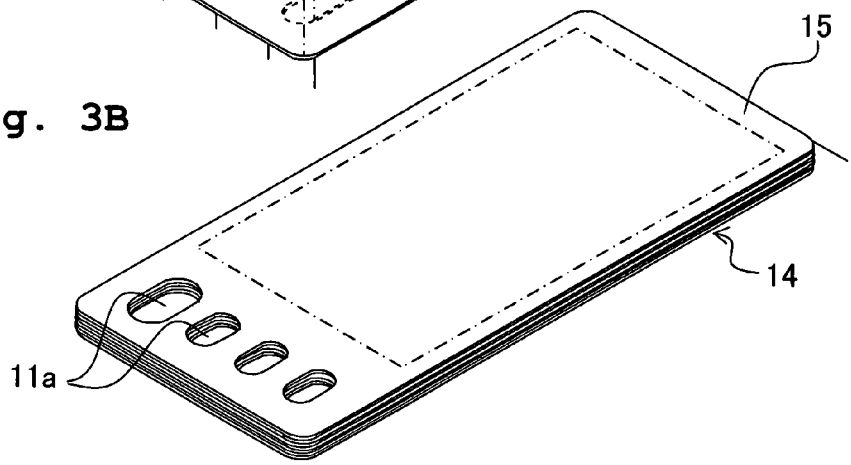
FIG. 3B is a view showing a state where the plates are bonded together.

As shown in FIG. 3A, the stack 14 is composed of the cavity plate 14A, a base plate 14B, an aperture plate 14C, two manifold plates 14D, 14E, and a damper plate 14F which are stacked in this order from the top. These six plates 14A to 14F are all metal plates and are bonded by metal diffusion bonding. These plates are aligned with one another so that the openings formed in each of the plates form individual ink channels communicating with the respective nozzles 16*a*. On the upper surface of the stack 14, the vibration plate 15 is further stacked and is bonded by metal diffusion bonding, as shown in FIG. 3B.

Figure 5:
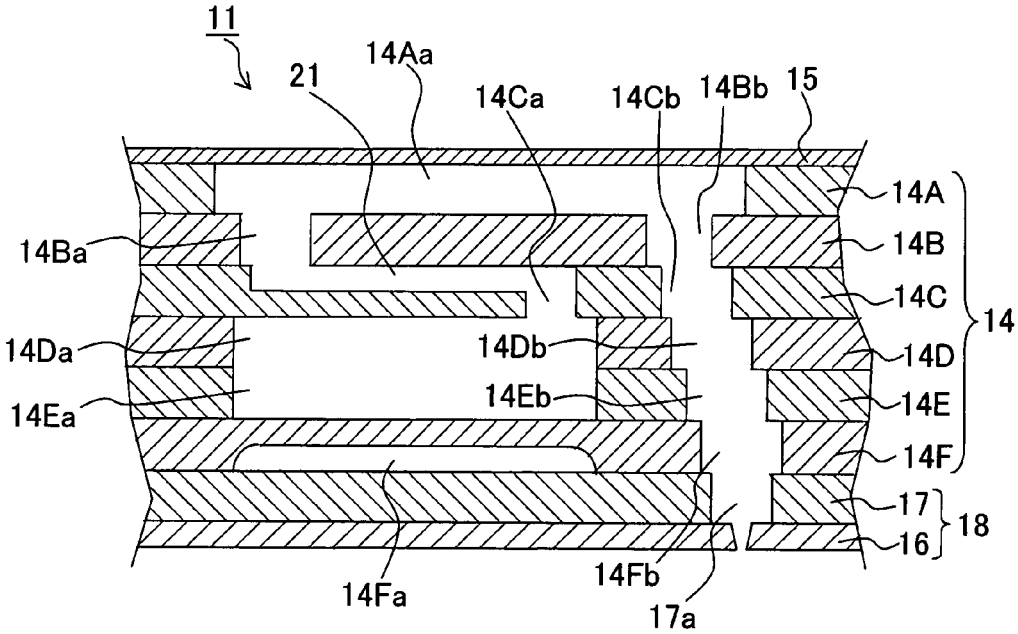
FIG. 5 is a cross-sectional view taken along line V-V in FIG. 4.
Figure 6:
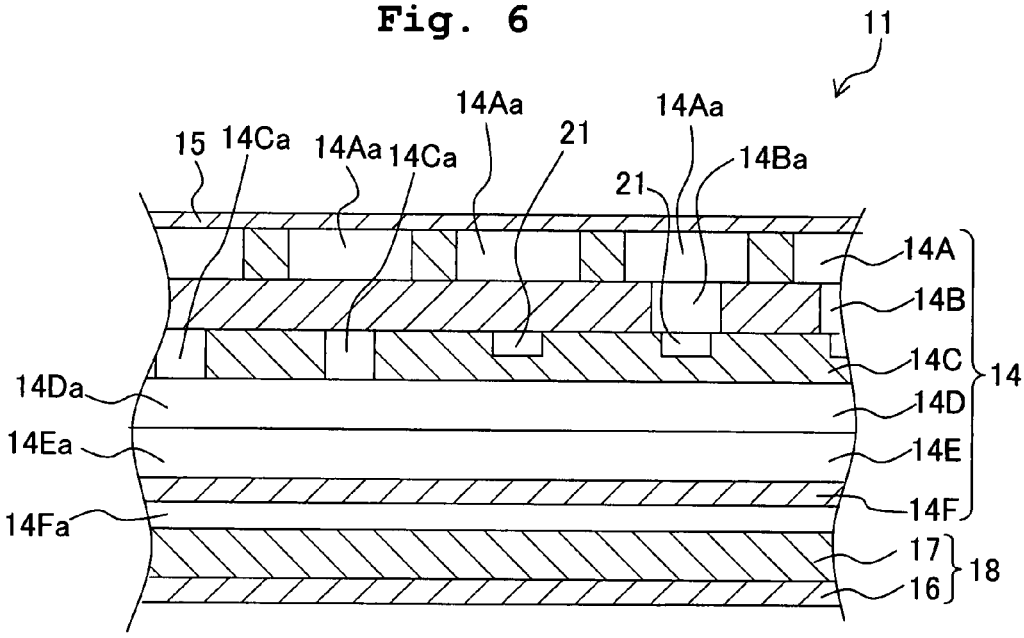
FIG. 6 is a cross-sectional view taken along line VI-VI in FIG. 4.

Next, the plates forming the stack 14 will be explained with reference to FIG. 3A, FIG. 5, and FIG. 6. FIG. 5 and FIG. 6 are cross-sectional views of the channel unit 11. As shown in FIG. 3A, the cavity plate 14A is a rectangular plate in which a plurality of cavities forming the pressure chambers 14Aa are arranged in the longitudinal direction of the plate to form a plurality of pressure chamber rows. These pressure chambers 14Aa (cavities) are formed as through holes in the cavity plate 14A by etching. As shown in FIG. 5 and FIG. 6, the vibration plate 15 is stacked on an upper surface of the cavity plate 14A, thereby forming an upper surface of the pressure chambers 14Aa (cavities).

Figure 7:
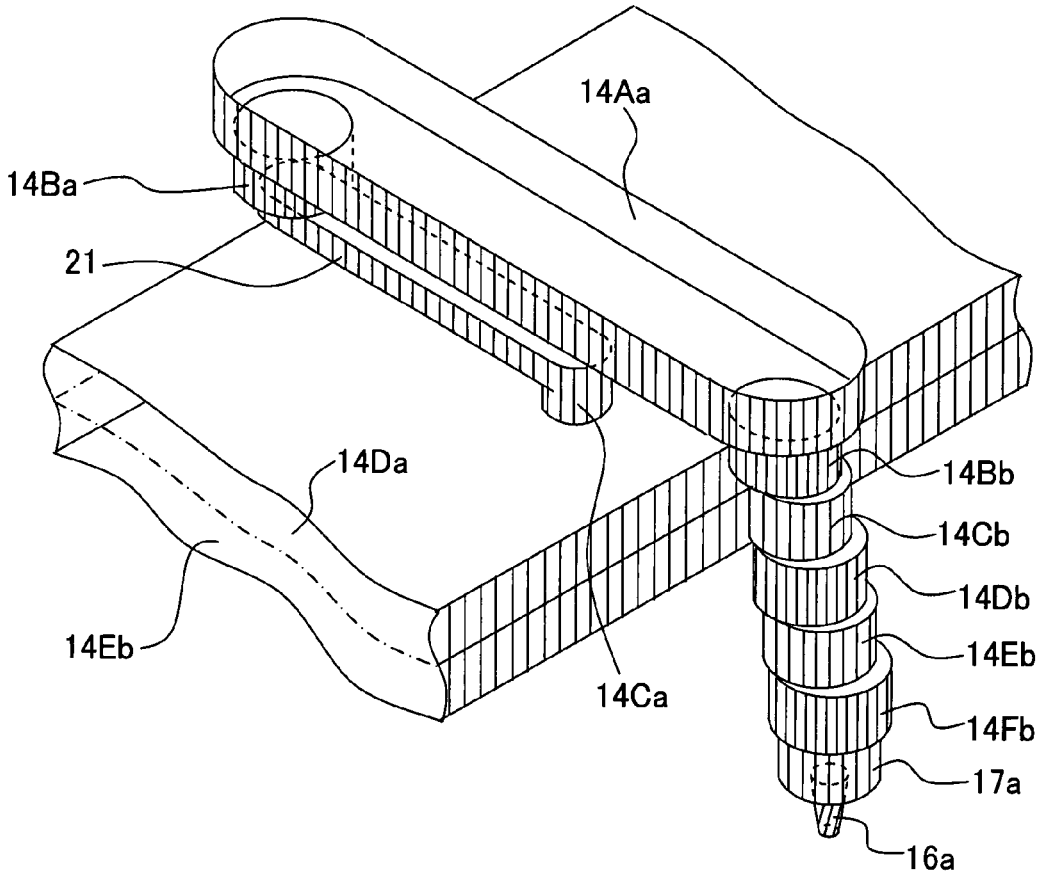
FIG. 7 is a view schematically showing an ink channel communicating with a nozzle.
Figure 8A:
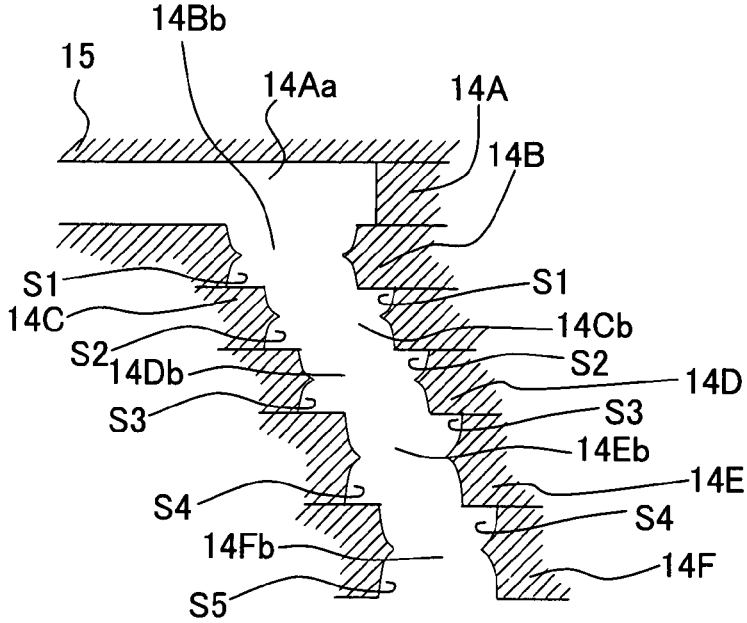
FIG. 8A is a fragmentary cross-sectional view of the ink channel before a low-viscosity curing material is filled in steps of the ink channel.

In the base plate 14B, communication holes 14Ba forming part of channels from manifolds 14Da, 14Ea (common ink chambers) (to be described later) to the pressure chambers 14Aa and communication holes 14Bb forming part of channels from the pressure chambers 14Aa to the nozzles 16*a* are formed. In an upper surface of the aperture plate 14C, communication channels 21 forming part of the channels from the manifolds 14Da, 14Ea to the pressure chambers 14Aa are formed as recessed channels, as shown in FIG. 5 and FIG. 6. Further, communication holes 14Ca forming part of the channels from the manifolds 14Da, 14Ea to the pressure chambers 14Aa and communication holes 14Cb forming part of the channels from the pressure chambers 14Aa to the nozzles 16*a* are formed. In the manifold plates 14D, 14E, the manifolds 14Da, 14Ea and communication holes 14Db, 14Eb forming part of the channels from the pressure chambers 14Aa to the nozzles 16*a* are formed respectively. In a lower surface of the damper plate 14F, recesses forming damper chambers 14Fa are formed as shown in FIG. 5 and FIG. 6. Further, communication holes 14Fb forming part of the channels from the pressure chambers 14Aa to the nozzles 16*a* are formed. The communication holes 14Bb, 14Cb, 14Db, 14Eb, and 14Fb (openings) forming the channels from the pressure chambers 14Aa to the nozzles 16*a* are formed by half etching. Therefore, each of these communication holes is actually smaller in diameter in a center portion in a plate thickness direction than in surfaces of the plate as shown in FIG. 8A, though shown in a simplified manner in FIG. 5 and FIG. 7, as having a cylindrical shape whose diameter is constant in the plate thickness direction.

Figure 4:
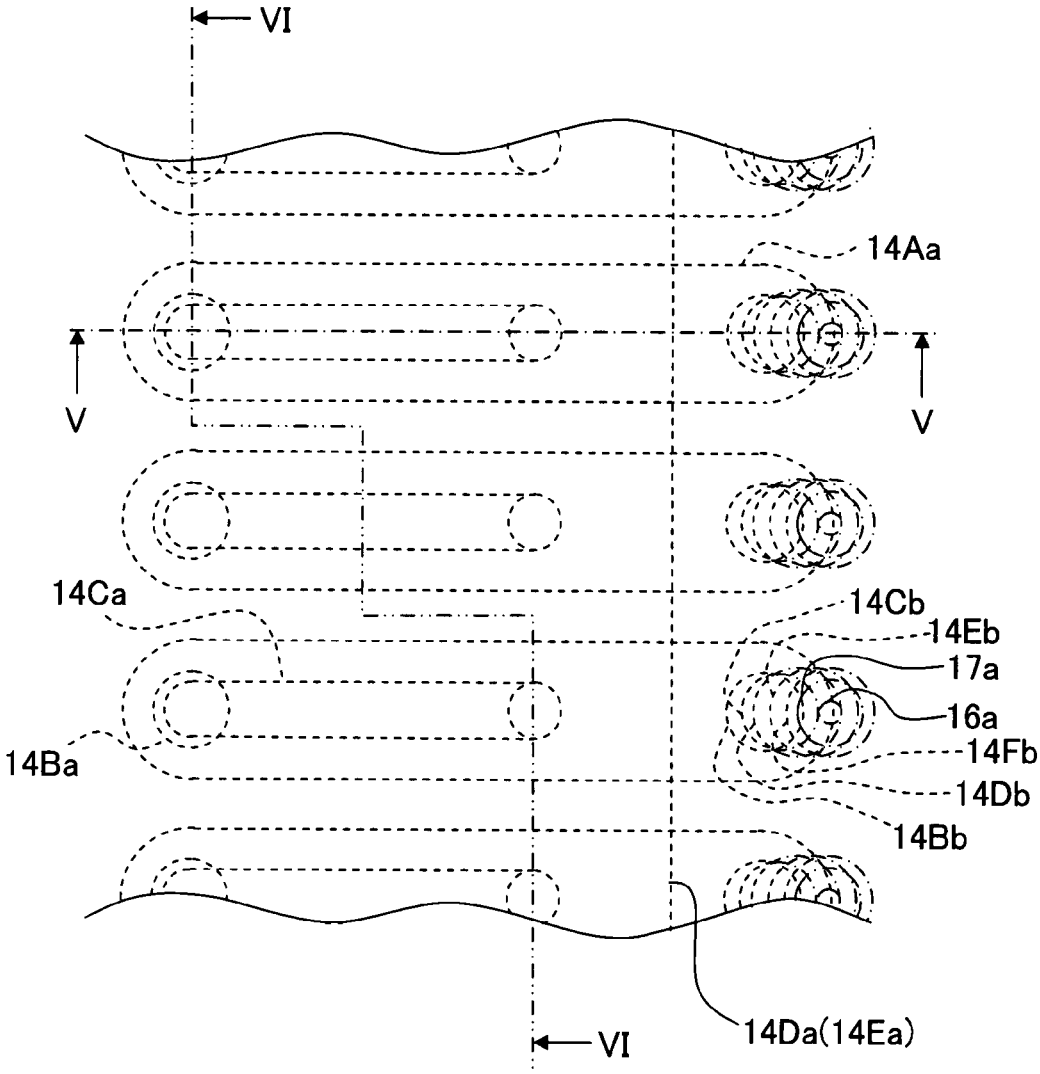
FIG. 4 is a plane view showing the arrangement relation between ink channels and pressure chambers.

The openings of the stacked plates 14A to 14F, 16, 17 overlap with one another to form the ink channels formed in the channel unit 11, and the ink flowing through the ink channels is discharged from the nozzles 16*a* of the head 3. That is, as shown in FIG. 7, the communication hole 14Ca, the communication channel 21, and the communication hole 14Ba form the channel extending from the manifolds 14Da, 14Ea to each of the pressure chambers 14Aa, and the communication holes 14Bb, 14Cb, 14Db, 14Eb, 14Fb, and the through hole 17*a* form the channel (liquid channel) extending from each of the pressure chambers 14Aa to each of the nozzles 16*a*. At this time, for example, if the communication holes 14Bb to 14Fb are formed at positions deviated from a predetermined position of the respective plates, the centers of the communication holes 14Bb to 14Fb deviate from one another in a plane view as shown in FIG. 4 when the plates are stacked. As shown in FIG. 8A, in an inner surface of the channel from the pressure chamber 14Aa to the nozzle 16*a*, steps S1 to S5 occur. For example, if the two adjacent plates 14B and 14C are focused on, a sidewall of the communication hole 14Cb formed in the one plate 14C and a surface, of the other plate 14B, bonded to the one plate 14C form the step S1. These steps S1 to S5 are formed as recesses with respect to the channel surface. Since each of the communication holes is formed by half etching and the diameter thereof becomes larger toward the surfaces of the plate as described above, the sidewall of the communication hole and the adjacent plate make an acute angle. This causes problems that bubbles easily remain in such steps S1 to S5 and it is difficult to discharge the residual bubbles even by purging.

Figure 8B:
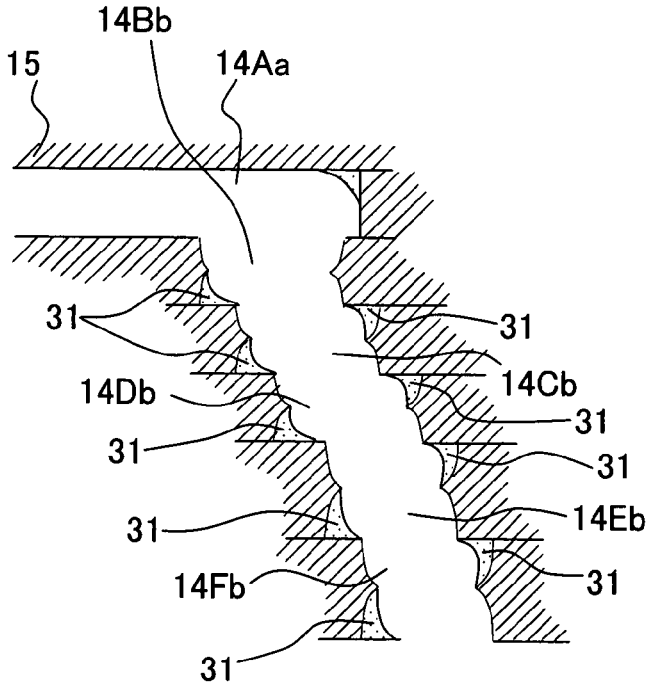
FIG. 8B is a fragmentary cross-sectional view of the ink channel after the low-viscosity curing material is filled in the steps of the ink channel.

Therefore, in the present invention, by a method to be described later, a low-viscosity curing material 31 is filled and solidified in the steps S1 to S5 formed due to the shift (positional deviation) of the communication holes 14Bb, 14Cb, 14Db, 14Eb, 14Fb communicating with the pressure chambers 14Aa, as shown in FIG. 8B. That is, the low-viscosity curing material 31 filled in the steps forms part of the inner surfaces of the liquid channels. Consequently, smooth ink channels whose inner surfaces have relatively small irregularities are formed in the channel unit 11. Therefore, the channel unit 11 with reduced residual bubbles and with excellent bubble discharging capability can be formed. Here, as the low-viscosity curing material 31, used is, for example, a thermosetting epoxy adhesive which cures at 100° C. to 150° C. The low-viscosity curing material 31 is completely dried after filled in the steps. It should be noted that "low viscosity" in the present invention refers to viscosity substantially equal to viscosity of water.

As shown in FIG. 2A, the actuator unit 12 includes a piezoelectric layer 12A formed on the vibration plate 15 and a plurality of individual surface electrodes 12B formed on an upper surface of the piezoelectric layer 12A so as to correspond to the respective pressure chambers 14Aa. Each of the individual surface electrodes 12B is made of a metal material such as an Ag—Pd based material or the like and has, in a plane view, an elliptical shape slightly smaller than the pressure chamber 12Aa, and in a plane view, are formed at positions overlapping with center portions of the corresponding pressure chambers 12Aa. Incidentally, on the surface of the piezoelectric layer 12A, terminals 12Ba are formed for the respective individual surface electrodes 12B. These plural terminals 12Ba are electrically connected to a driver IC (not shown) via the flexible cable 13 shown in FIG. 1B. The driver IC supplies a driving voltage selectively to the individual surface electrodes 12B via the terminals 12Ba.

The piezoelectric layer 12A is made of a ferroelectric ceramic material such as a lead zirconate titanate (PZT)-based material, and is polarized in its thickness direction. The vibration plate 15 serves as a common electrode to cause an electric field to act on the piezoelectric layer 12A between the individual surface electrodes 12B and the vibration plate 15 and is constantly kept at ground potential.

Therefore, setting the potential of the individual surface electrode 12B higher than the ground potential causes the electric field to be applied to the piezoelectric layer 12A in its polarization direction. The piezoelectric layer 12A to which the electric field is applied contracts as an active layer in a direction perpendicular to the polarization direction due to a piezoelectric transverse effect. On the other hand, the vibration plate 15 does not spontaneously contract, and consequently, there occurs a difference in distortion in the direction perpendicular to the polarization direction between the piezoelectric layer 12A and the vibration plate 15. Since the vibration plate 15 is fixed to the cavity plate 14A, the piezoelectric layer 12A and the vibration plate 15 try to deform so as to bulge (to be convex) toward the pressure chamber 14Aa (unimorph deformation). Accordingly, the volume of the pressure chamber 14Aa decreases to increase the pressure of the ink, and the ink is consequently jetted from the nozzle 16*a*. Thereafter, when the individual surface electrode 12B is returned to the same potential as that of the internal common electrode (vibration plate 15), the piezoelectric layer 12A and the vibration plate 15 restore their original shapes. Therefore, the volume of the pressure chamber 14Aa returns to the original volume, and accordingly, the pressure chamber 14Aa sucks the ink from the manifolds 14Da, 14Ea.

As described above, in this embodiment, since the vibration plate 15 is provided on the upper surface of the channel unit 11, it is possible to realize excellent jetting efficiency owing to the unimorph deformation.

Next, a method for producing the ink-jet head 1 will be explained. First, the plates 14A to 14F forming the stack 14 and the vibration plate 15 are integrally bonded by metal diffusion bonding. The vibration plate 15 is bonded on the upper surface of the cavity plate 14 so as to cover the pressure chambers 14Aa. Here, the plates 14A to 14F and the vibration plate 15 are made of a metal material such as stainless steel, and openings and through holes are formed in the plates 14A to 14F by half etching, etching, press forming, or the like. As a result of the bonding of the plates 14A to 14F and the vibration plate 15, the openings formed in each of the plates communicate with one another to form the liquid channels (first step). Since the vibration plate 15 faces the individual surface electrodes 12B to serve as the common electrode generating an electric field on the piezoelectric layer 12A, it is not necessary to provide a common electrode separately from the vibration plate 15, which simplifies the structure of the piezoelectric actuator.

Next, the piezoelectric layer 12A is formed on the surface, of the vibration plate 15, not facing the channel unit 11 by an aerosol deposition method (AD method). Specifically, ultrafine particle materials (particles of PZT) are made to collide with the surface to be processed (front surface) of the vibration plate 15 at high speed to be deposited on the surface, thereby forming the piezoelectric layer 12A on the vibration plate 15.

After the piezoelectric layer 12A is thus formed on the front surface of the vibration plate 15, annealing is performed so as to ensure that the piezoelectric layer 12A has a sufficient piezoelectric characteristic. Thereafter, on the surface of the piezoelectric layer 12A, the individual surface electrodes 12B are formed on areas overlapping with the pressure chambers 14Aa respectively in a plane view, by a screen printing method, a deposition method, a sputtering method, or the like.

Thereafter, the low-viscosity curing material 31 in a liquid form (or mist form) is introduced into the ink channels (see FIG. 7) formed by the stack 14 and the vibration plate 15 from the openings 11*a* of the channel unit 11 and is discharged from the communication holes 14Fb of the damper plate 14F (second step). Consequently, the low-viscosity curing material 31 is filled in the steps which are formed in the inner surfaces of the ink channels due to the shift of the communication holes 14Bb, 14Cb, 14Db, 14Eb, 14Fb (openings) formed in the adjacent plates 14A to 14F respectively (see FIG. 8B). Here, as the low-viscosity curing material, a thermosetting low-viscosity adhesive is used. As the adhesive, desirable is an adhesive that does seep out or is difficult to seep out into the ink while the ink-jet head is in use.

Figure 9:
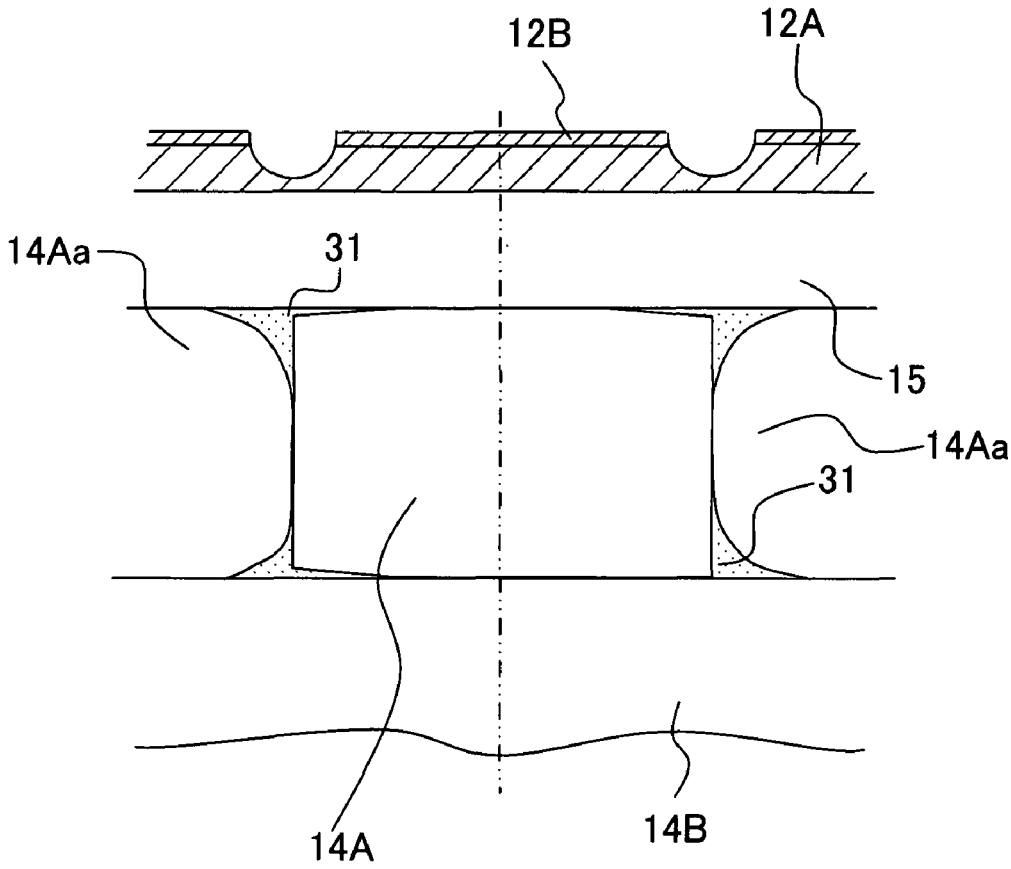
FIG. 9 is a cross-sectional view showing the vicinity of a pressure chamber, where the curing material is buried in small gaps between plates.
Figure 10A:
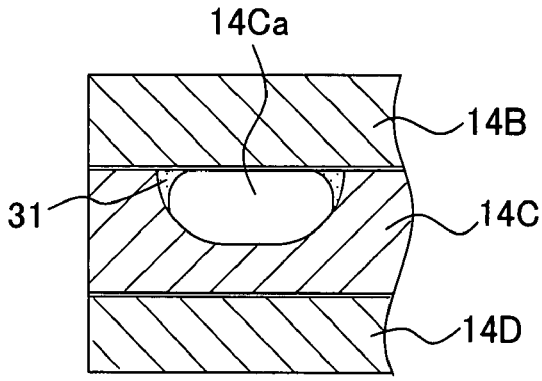
FIG. 10A to FIG. 10C are cross-sectional views showing difference in filling degree of the curing material in constriction portions having different sizes, each showing the vicinity of the constriction portion.
Figure 10B:
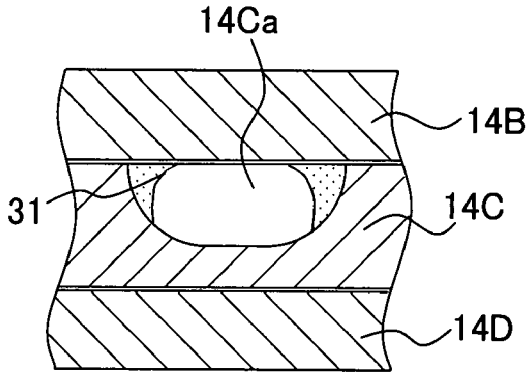
Figure 10C:
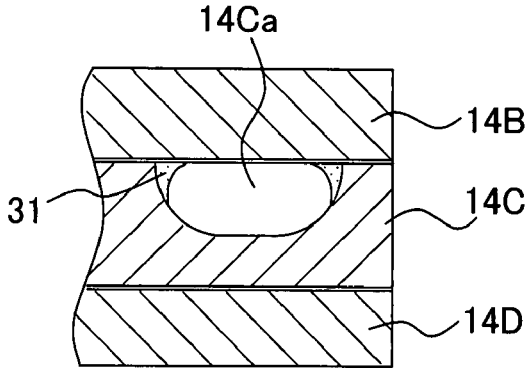

At this time, not only the aforesaid steps but also small gaps occurring, for example, between the plates are filled with the curing material 31 as shown in FIG. 9. Further, in a case where a channel has a portion with a large channel diameter and a portion with a small channel diameter, the velocity of a fluid flowing in the channel is generally lower in the portion with the large channel diameter than in the portion with the small channel diameter. Therefore, the fluid stays more easily in the portion with the large channel diameter than in the portion with the small channel diameter. Since the communication holes 14Ca are formed in the aperture plate 14C by half etching, there may be a case where some of the communication holes 14Ca are formed to have a normal cross-sectional dimension (channel diameter), some of them are formed to have a cross-sectional dimension larger than the normal dimension, and some others are formed to have a cross-sectional dimension smaller than the normal dimension, for example, as shown in FIGS. 10A to 10C. Therefore, if the curing material 31 is made to flow in the channels whose communication channels 14Ca are uneven in dimension, the curing material 31 stays in the communication hole 14Ca with a large dimension, while the curing material 31 does not stay in the communication hole 14Ca with a small dimension, which as a result can unify the cross sectional dimensions of the communication holes 14Ca.

Next, a high-temperature air at about 70° C. to 150° C. as a curing fluid for curing the low-viscosity curing material 31 is made to flow in the liquid channels until the curing material 31 is dried (third step). Concretely, for example, the time expected to be taken to dry the curing material 31 is measured in advance through experiments, and the high-temperature air is made to flow in the liquid channels during this time, thereby drying and solidifying the curing material 31. The high-temperature air is introduced from the openings 11*a* of the channel unit 11 and discharged from the communication holes 14Fb of the damper plate 14F as in the second step. The curing fluid flowing in the liquid channels can provide not only the effect of curing the curing material 31 but also an effect of preventing the curing material 31 from remaining in portions originally smooth in the channels. That is, it is possible to obtain an effect that the curing material 31 can be filled only in portions that need smoothing, such as the steps and the like in the channels.

Consequently, the curing material 31 is filled in the steps and is solidified. The curing material 31 is also filled in gaps, flaws, and recesses formed in the ink channels and solidified. The inner surfaces of the ink channels are partly formed by the solidified curing material 31. That is, the ink channels having smooth channel surfaces are formed because the steps and gaps formed in the ink channels due to shift of the communication holes 14Bb, 14Cb, 14Db, 14Eb, 14Fb and flaws and the like in the ink channels are filled with the curing material 31.

Finally, the plate assembly 18 is bonded to the lower surface of the stack 14 by a curing material (fourth step), whereby the production of the ink-jet head 1 is completed. Even in a case where a water repellent film is formed on a nozzle surface of the nozzle plate 16 of the plate assembly 18, such post attachment of the plate assembly 18 (nozzle plate 16) makes it possible to avoid such a situation that the aforesaid curing material 31 adheres to the water repellent film to adversely affect a water repellent effect.

In the producing processes of the ink-jet head 1 explained above, the plate bonded in the fourth step may be only the single nozzle plate 16. Further, in a case where the nozzle plate 16 and the spacer plate 17 are metal plates made of stainless steel or the like, the nozzle plate 16 and the spacer plate 17 may also be bonded by metal diffusion bonding simultaneously with the vibration plate 15 and the plates 14A to 14F forming the stack 14, thereby forming the channel unit 11 first. In this case, the fourth step is omitted.

In the above-described embodiment, the high-temperature air at about 70° C. to 150° C. is used as the curing fluid for curing the low-viscosity curing material 31, but the curing fluid is not limited to this. For example, any liquid, other than the thermosetting adhesive, that does not mix with the thermosetting adhesive may be used, providing that it can cure the low-viscosity curing material 31. Further, to cure the low-viscosity curing material 31 and fill the curing material 31 only in the steps and the like in the channels, a room-temperature air may be made to flow in the channels while surrounding areas of the channels are heated by a heater or the like.

In the above-described embodiment, the thermosetting adhesive is used as the low-viscosity curing material 31, but a photo-curing adhesive may be used as the adhesive in a case where the channels are made of, for example, light transmissive glass or the like.

The above embodiment has explained the example where the communication holes 14Bb to 14Fb are formed by half etching, but the present invention is also applicable to a case where each of these communication holes is formed by etching so as to have a constant diameter. That is, even if the communication holes are formed by etching, steps occur in the channels as shown in FIG. 5 if the communication holes are deviated from one another, and therefore, applying the present invention can provide the same effects as those of the above-described embodiment.

The embodiment explained above is an example where the present invention is applied to the ink-jet printer head, but the application of the present invention is not limited to such a form. For example, according to the present invention, it is possible to smooth inner surfaces of liquid channels that have already been formed, and therefore, the present invention is applicable not only to the ink-jet printer but also to a head of any of liquid discharging apparatuses used in various fields such as a field of medicine, a field of analytics, and the like.

What is claimed is:

1. A method for producing a liquid discharging head which discharges a liquid from a nozzle of a channel unit formed by stacking a plurality of plates each of which has openings, the method comprising:

a first step for bonding the plates by metal diffusion bonding and making the openings of the plates communicate with one another to form a liquid channel;

a second step for introducing a curing material in a liquid form or a mist form throughout the liquid channel; and a third step for introducing a fluid to the liquid channel until the curing material is dried.

2. The method for producing the liquid discharging head according to claim 1, wherein the openings are formed by half etching.

3. The method for producing the liquid discharging head according to claim 1, wherein the curing material is a thermosetting adhesive, and the fluid is a high-temperature air.

4. The method for producing the liquid discharging head according to claim 3, wherein a temperature of the high-temperature air is about 70° C. to about 150° C.

5. The method for producing the liquid discharging head according to claim 1, wherein the plates include a nozzle plate stacked on an outermost side of the channel unit;

other plates among the plurality of plates which are different from the nozzle plate are bonded to form a stack in the first step;

and the method further comprising, after the third step, a fourth step for bonding the nozzle plate to the stack.

6. The method for producing the liquid discharging head according to claim 5, wherein in the fourth step, the nozzle plate is bonded to the stack by an adhesive.

7. The method for producing the liquid discharging head according to claim 1, wherein the first step further includes forming a piezoelectric layer by an aerosol deposition method after forming the liquid channel.

8. The method for producing the liquid discharging head according to claim 7, wherein the first step further includes forming a plurality of individual surface electrodes on the piezoelectric layer.

* * * * *